United States Patent [19]

Augusta

[11] 4,448,423

[45] May 15, 1984

[54] BOARD GAME

[76] Inventor: George V. Augusta, 40 Reinert 71 John Wise Ave., Essex, Mass. 01929

[21] Appl. No.: 419,756

[22] Filed: Sep. 20, 1982

[51] Int. Cl.[3] ..... A63F 3/00

[52] U.S. Cl. ..... 273/272; 273/285

[58] Field of Search ..... 273/265, 269, 272, 273, 273/280, 285, 287

[56] References Cited

U.S. PATENT DOCUMENTS

| | | | |
|---|---|---|---|
| 850,489 | 4/1907 | Price | 273/285 X |
| 1,553,835 | 9/1925 | Peters | 273/272 |
| 2,757,934 | 8/1956 | Dunbar | 273/272 |
| 2,766,987 | 10/1956 | Seelbrede | 273/272 X |
| 2,774,598 | 12/1956 | Strocco | 273/285 X |
| 3,077,677 | 2/1963 | Malkin | 273/272 X |
| 3,413,004 | 11/1968 | Smith | 273/272 X |
| 3,565,439 | 2/1971 | Krouse | 273/272 |
| 4,384,722 | 5/1983 | Higgins | 273/272 |
| 4,420,157 | 12/1983 | White | 273/272 |

*Primary Examiner*—Harland S. Skogquist

*Attorney, Agent, or Firm*—Edward A. Gordon

[57] ABSTRACT

Apparatus for playing a competitive scoring game including a flat playing surface divided into upper and lower sections, a plurality of playing pieces, and randomized selector holders for holding sets of playing pieces during play. The playing pieces include reference indicia on the top surface to indicate alphabetic consonants, vowels, and blanks which may represent consonants or vowels. The playing pieces are provided with further indicia of color to distinguish each players set of playing pieces and further indicia on the bottom surface to distinguish playinig pieces having consonants from those having vowels or blanks. The object of the game is to form colorwords by juxtaposing colored letter carrying playing pieces in the upper section. The colorwords may be extended to form other words. The word is won, when no further letters can be added, by the player whose colored letters outnumber those of any other players. The lower section is used to discard playing pieces in juxtaposition to form words. Playing pieces may be substituted in the lower section to obtain particular letters and/or colored letters for play in the upper section so long as the substitution forms a word.

11 Claims, 13 Drawing Figures

BOARD GAME

FIELD OF THE INVENTION

The present invention relates to a board game apparatus and more particularly to a board game apparatus with tiles carrying color and letters which are used to form colorwords.

BACKGROUND AND SUMMARY OF THE INVENTION

While board games are common, the present invention combines unusual board game features and provides an exciting and fun game designed for the maximum enjoyment by players of varying ages. The game apparatus, designed for attractiveness, utility of use, and inherent educational value, comprises a first group of tiles or playing pieces, which are lettered and subdivided by indicia of color and a second group of tiles or playing pieces which are colorless (white for example). While the white tiles cannot represent a color, they serve every other purpose of a letter tile. The game board is divided into two sections, comprising an upper section and a lower section. The upper section receives tiles for forming words which are scored, while the lower section serves as a crib for letters which are discarded as words. Each player is represented by the color alphabet set selected before the game. While scoring takes place in the upper section of the game board through the winning of colorwords, the upper and lower sections of the game board are equally important. Play normally takes place in both sections during a single turn, and some or all of the letters drawn by the player in his turn may be substituted for letters in the lower section in order to acquire particular color letters.

The object of the game is to form colorwords for score in the upper section. A colorword is always begun with the letters of a player's own color. During succeeding turns the players may add letters of any color before or after the word provided a word continues to be formed. When no further letters can be added to a colorword, the player whose color letters outnumber those of any other color wins the word. Other outcomes are possible when extending a colorword. An opposing player may "steal" the colorword by adding a greater number of his own color letters. Also, a colorword may be neutralized if there is an equal number of letters of 2 or more colors, and no more letters can be added. In such a case, the word may not be scored. The lower section, or crib, has three functions. The first function is the discarding of letters in the form of a word, or words. The second function of the crib is to be a letter pool. A letter drawn by a player may be substituted for a letter in a crib word provided a word remains in the crib. Thirdly, a letter from the player's rack may substitute for the same letter of a different color in the cribword. Although scoring only takes place in the upper section through the winning of colorwords, the upper and lower sections are each important in the play. Play normally takes place in both sections during a single turn. Some or all of the letters drawn by a player in his turn may be substituted for letters in cribwords in order to acquire particular color letters, all as described in more detail hereinafter. In one preferred embodiment of the invention, there is associated with the gameboard a randomized playing piece or tile selector holder for each player.

A desirable object of the present invention is to provide a new or improved board game apparatus.

A still further desirable object is to provide a board game designed for maximum enjoyment by players.

A still further desirable object of the present invention is to provide an improved board game where words are controlled by a color factor.

A further desirable object of the present invention is to provide an improved board game which provides for release of playing pieces not in play.

A still further desirable object of the invention, is to provide a game board which provides for more challenging options and maximizes use of playing pieces beyond random drawing.

A still further desirable object of the invention is to provide a board game designed for utility of use, inherent educational value, and which is esthetically pleasing to the players.

BRIEF DESCRIPTION OF THE DRAWING

For a fuller understanding of the nature and desired objects of this invention, reference should be made to the following detailed description taken in connection with the accompanying drawing, wherein like reference characters refer to a corresponding part throughout the several views of the preferred embodiments of the invention and wherein:

Referring now to FIGS. 1 and 1A, there is shown a perspective view of the game board 10 as used in the present invention. As shown in FIGS. 1 and 1A, the game board 10 is basically square so that it is adapted for use by from 2 to 4 players, although other shapes, such as rectangular, can be used to accomodate more players. Referring more especially to FIG. 1, board 10 is provided with a playing surface 12 thereon which is divided into a coordinated grid or network of strips 14 and 16 which divide the board into a multiplicity of squares 18 upon which playing pieces 26 are adapted to be placed during progress of the game. The board 10 is divided into an upper section 20 and a lower section 22 by dividing strip 24. The board 10 may be formed of a suitable material such as cardboard, wood, metal, plastic or other desirable material. In the preferred embodiment, the upper section 20 is provided with a greater area than lower section 22 to accomodate more play activity although the areas may be varied.

The strips 14, 16 and 24 may be applied in any suitable manner to the surface 12 of board 10, such as for example by embossing, printing, or inlaying in the board.

Figure 2:
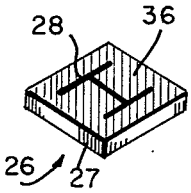
FIGS. 2, 3, 4, 5 and 6 are perspective views of typical playing pieces or tiles which may be used in accordance with the invention.
Figure 3:
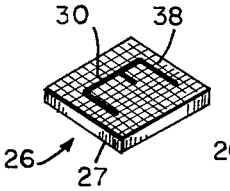
Figure 4:
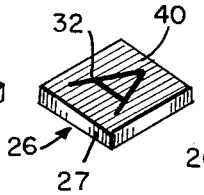
Figure 5:
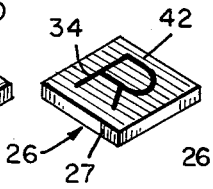
Figure 6:
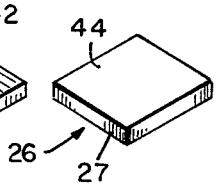

The playing pieces or tiles 26 adapted for use in the present invention are shown in FIGS. 2, 3, 4, 5 and 6 of the drawing and comprise a block or tile 27 made of suitable material such as cardboard, wood, metal, plastic or other desirable material and bearing first identifying means or indicia which in the case of FIGS. 2, 3, 4 and 5 comprises a letter of the alphabet, H, 28; E, 30; A, 32; and R, 34. In the case of FIG. 6, there is an absence of such first indicia. All tiles bear a second identifying means or indicia which comprises indicia of color. In FIG. 2, the indicia means 36 represents green; in FIG. 3, the indicia means 38 represents orange; in FIG. 4 indicia means 40 represents red; in FIG. 5 indicia means 42 represents blue; and in FIG. 6 indicia means 44 represents white. Tiles with a white indicia are hereinafter sometimes referred to as blanks. The tiles 26 are of approximately the same area as one of the squares 18, and in any case its area should not be more than the area of a square 18 when strips 14 and 16 on each side of the tile are embossed or raised to provide recesses and prevent accidental movement of the tiles. When the strips 14 and 16 are not raised or embossed, but are printed, the tiles should not be more than the area of a square 18 plus one-half the width of the strips 14 and 16 on each side of the tile. In the embodiment of the game board illustrated in FIG. 1A, the tiles are placed adjacent to each other in end to end relationship and are thereby held in substantial alignment.

Within the scope of the invention, the placement of the tiles or playing pieces 26 upon the sections of board 10 are determined in the manner appropriate to the rules for playing the particular game to which the principles of the invention are applied.

In the preferred embodiment of the invention, the tiles 26 are provided with a third identifying means or indicia at least on the reverse side of each. As will be described hereinafter, the third indicia serves to distinguish tiles having indicia on its face which is an alphabetic consonant indicia from those tiles having an alphabetic vowel indicia or blank indicia on the face thereof.

Figure 1:
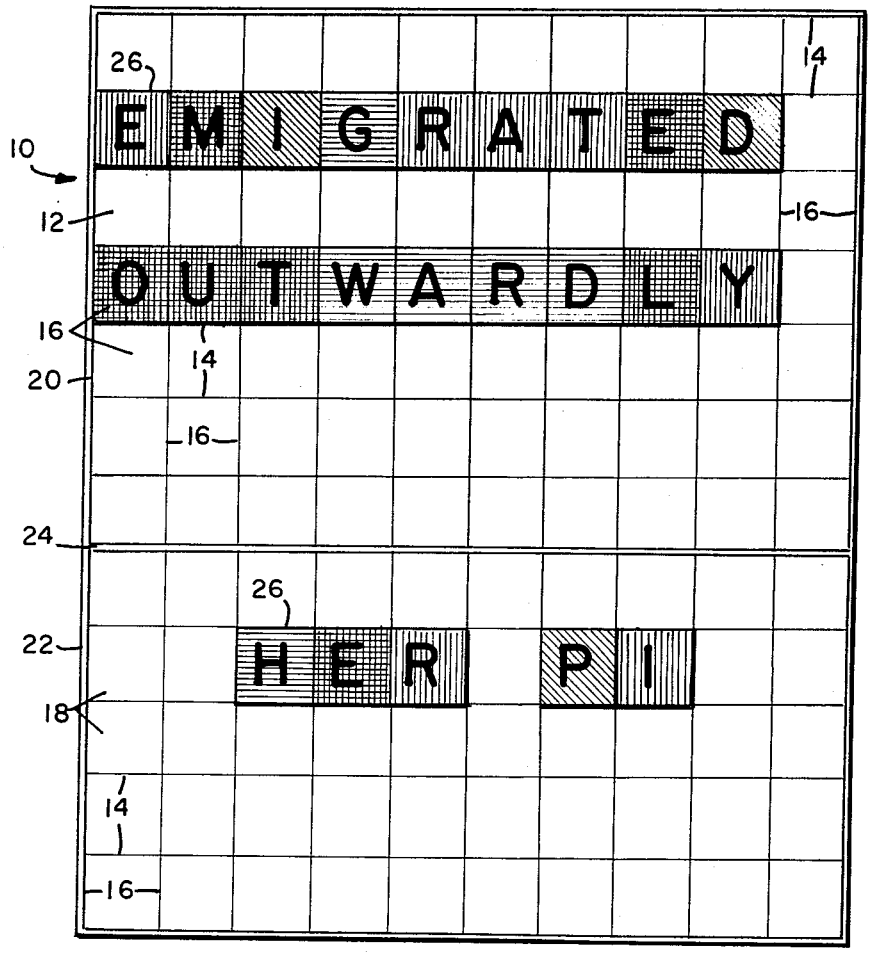
FIG. 1 is a plan view of the game board showing the grided upper and lower sections printed thereon, and associated randomized playing piece selector holders according to the invention.
Figure 1:
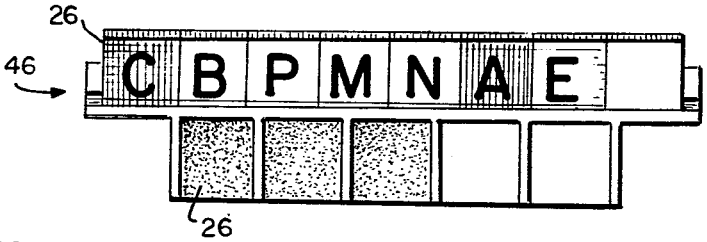
Figure 7:
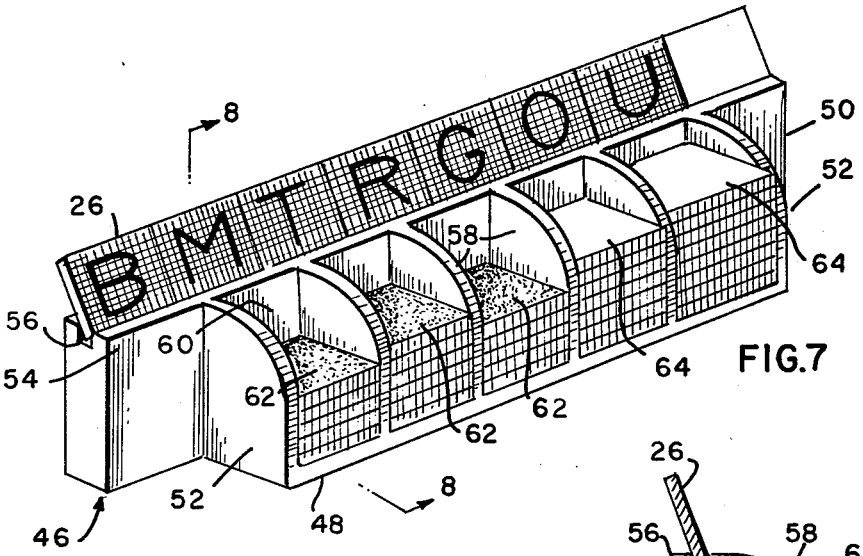
FIG. 7 is a perspective view of a preferred embodiment of the randomized playing piece selector holder according to the present invention showing the playing pieces therein.
Figure 8:
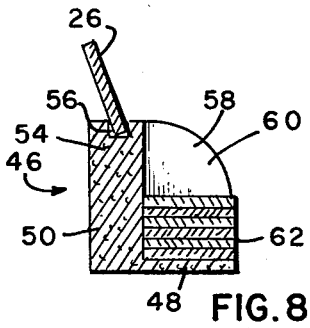
FIG. 8 is a cross-sectioned view of the selector holder of FIG. 7.

Referring now more particularly to FIGS. 1, 7 and 8, there is shown the randomized playing piece selector holder shown generally at 46. The playing piece or tile holder 46 preferably comprises a base 48, a front wall 50, side walls 52 and a top portion 54, having a groove 56. The holder 46 is preferably provided with a plurality of partitions 58 to divide the holder into a plurality of bins 60 for holding the tiles 26. In the preferred embodiment 5, bins are provided. Three bins are employed to hold face down tiles selected at random but having indicia or legend 62 on the reverse side indicating that the tile has first indicia on the face side representing an alphabetic consonant character. The indicia or legend 62 in this case is preferably a dark color not otherwise employed. Two bins are employed to hold face down tiles selected at random but having indicia or legend 64 on the reverse side indicating that the tile has first indicia on the face side representing an alphabetic vowel or blank character. In this case, the indicia or legend 64 is the same color as 62, but sufficiently lighter to be easily distinguishable from each other. It is to be understood that indicia 62 and 64 can be suitable marks or symbols to distinguish one from the other. In the preferred embodiment, the groove 56 serves as a rack to hold the tiles which are selected from the bins 60 in face up position ready for play.

Figure 9:
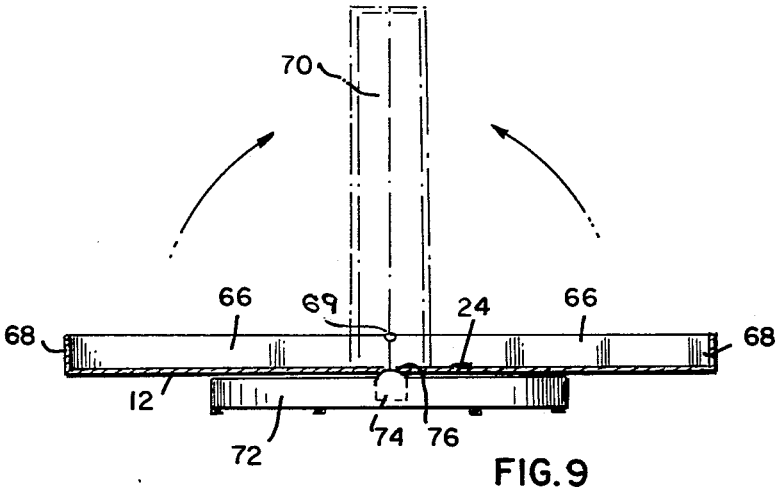
FIG. 9 is a modified form of the game board of FIGS. 1 and 1A.

Referring now to FIG. 9, there is illustrated a modified form of the grame board 10. In this form, the playing surface 12 is provided with side walls 66 and end walls 68. In this form suitable hinge means 69 may be positioned in walls 66 so that the game board can be folded to the closed position shown by the arrows. In the closed position, the game board surface 12 and walls 66 and 68 form an interior chamber 70 within which the tile holders 46 and tiles 26 can be contained when not in use.

In the preferred embodiment of the invention, the playing tiles 26 number 120 pieces. Each of the face segments, of 116 of the tiles 26, is adapted to carry first indicia of alphabetic characters and second indicia representing a players set of playing pieces as described hereinafter. The reverse sides of these 116 tiles carry third indicia indicating a light color where the first indicia on the face side is an alphabetic vowel character, and indicia of dark color where the first indicia on the face side is an alphabetic consonant character. In addition to the colored and lettered tiles, there are four unlettered tiles having first indicia 44 representing blank or white face sides and indicia 64 representing a light colored reverse side. A white tile may represent any letter in play, including "Qu". Although a white tile cannot represent a color, it serves every other purpose of a letter tile. A white tile remains the designated letter until replaced by that letter, of any color, in either the upper or lower playing sections. A white tile may not replace a letter tile already played.

The 116 lettered tiles comprise four 29 character set alphabets, distinguishably different, in that the second indicia of the face side of each set is of a distinctively different color. Additionally, each 29 character set comprises an alphabet of a variable number of first indicia comprising consonants or vowels based upon the frequency of occurence in the English language.

It can be seen that the invention may be adapted for other languages by using an alphabetic frequency table for the other languages, to construct the game alphabet sets. An example of the four sets of 29 characters each is shown in the following table:

TABLE ILLUSTRATING EXAMPLE OF FOUR PLAYING SETS

| 2nd Indicia (color) | 1st Indicia (letters) | | | | | | | | | | | | | | | | | | | | | | | | | | |
|---|---|---|---|---|---|---|---|---|---|---|---|---|---|---|---|---|---|---|---|---|---|---|---|---|---|---|---|
| 1st set orange | A | A | B | D | E | E | E | G | H | I | I | I | K | L | M | N | N | O | O | Qu | R | R | S | S | T | T | U | W | Y | * |
| 2nd set green | A | A | C | D | E | E | E | E | F | G | H | I | I | L | M | N | N | O | O | R | R | S | S | T | T | U | V | X | Y | * |
| 3rd set red | A | A | A | C | D | E | E | E | H | H | I | I | J | L | M | N | N | O | O | P | R | R | S | S | T | T | U | W | Y | * |
| 4th set blue | A | A | B | C | D | E | E | E | F | H | H | I | I | L | N | N | O | O | O | P | R | R | S | S | T | T | U | Y | Z | * |

* = blank

The game may conveniently be played by from two or four players. Play consists of forming words, and extending words previously built.

Play begins by turning all tiles face down before the players in a well shuffled state, keeping the light and dark tiles separate.

To start the game, each player selects a color and receives a tile-holder containing all the letter-tiles he will draw during play. 5 dark (consonant) and 3 light (vowel or blank) tiles are drawn from the bins and placed in groove or rack of the tile holder. The same complement of tiles is maintained after each turn. However, any combination of light and dark tiles is drawn when there is an insufficient number of either light or dark tiles, or fewer than 8 tiles remaining in the player's bins. The player whose first dark tile drawn is closest to the letter "B" becomes the first player.

To load the bin holders, the tiles are turned face down, keeping the light and dark tiles separate. Mix both piles separately. Place 6 tiles in each bin of each of the tile holders as follows: 6 dark tiles in each of 3 bins and 6 light tiles in each of 2 bins of each tile holder. In a 4 player game each player uses 1 tile holder and, in a 2 player game, each player uses 2 tile holders. In a 3 player game, 2 tiles are added from each bin of the extra tile holder to each bin of the other 3 tile holders.

The player to start initiates a colorword, or colorwords, on the upper playing surface, using only his own color and letters and/or white tiles. When he has completed play he must draw additional tiles from his tile bins to maintain the same complement of tiles, i.e., five dark tiles (consonants) and three light tiles (vowels or blanks) in the tile holder rack.

Play preferably passes to the left and the second player, and then each in turn, may form a colorword or may add letters of any color and/or white tiles before or after the existing colorwords on the upper playing surface. The letters added must continue to form a word. Thus, new words may be formed in two directions. All adjacent letters must form complete words, and at no stage may an incomplete word appear on the board. Upon completing his turn of play, each player must draw additional tiles to maintain the 3 to 5 vowel-consonant ratio in his holder, in the manner of the first player.

All plays must be based on words found in a standard dictionary agreed upon by the players. Hyphenated words which stand alone are permitted. Words which are capitalized, abbreviations, unattached prefixes and suffixes, and contractions are not permitted. The dictionary may only be consulted when a challenge is made. Any challenge to a colorword must be made before the end of a turn, and to a lower section or cribword immediately after it is played. Any letters played on a colorword during a turn in which it is successfully challenged must be returned to the bins in the challenged players holder. Any cribword successfully challenged must be restored as it was before the challenge.

Letters may be discarded in the crib, the lower playing section, only in the form of a word, or words, of two or more letters. Unlimited letter substitutions may be made in the crib. During his turn, a player may substitute a letter in his tile holder groove for the same letter of a different color in a cribword or, for a different letter, provided a word remains after the substitution in the cribword.

The game ends when one player has played all the tiles in his holder and after each player succeeding him in turn has played. Scoring of the play is now calculated. A player "wins" a colorword when there are more of his color letters in the word than those of any other color and when the dominance of his color letters cannot be overcome by adding more letters. Each tile in a colorword won by a player scores one point. Each unplayed tile reduces a players' score by one point. Each loss of a challenge reduces a player' score by three points.

Figure 1A:
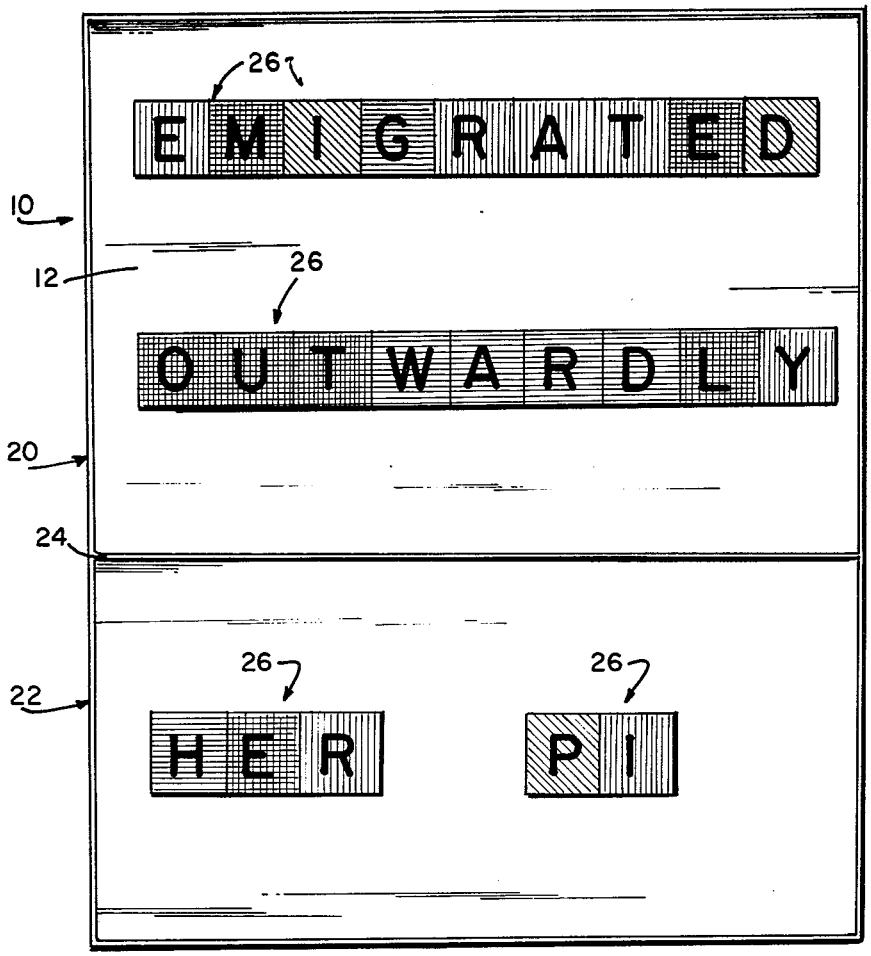
FIG. 1A is a plan view of the game board of FIG. 1 having a modified playing surface in that the upper and lower sections are not grided.
Figure 1A:
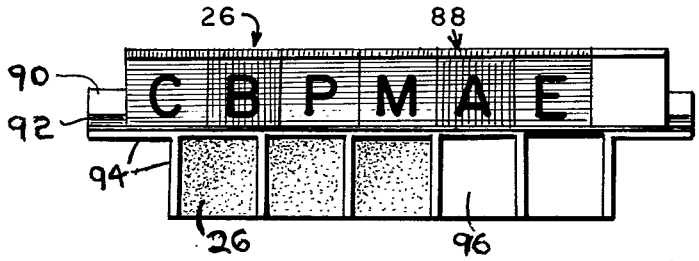
Figure 10:
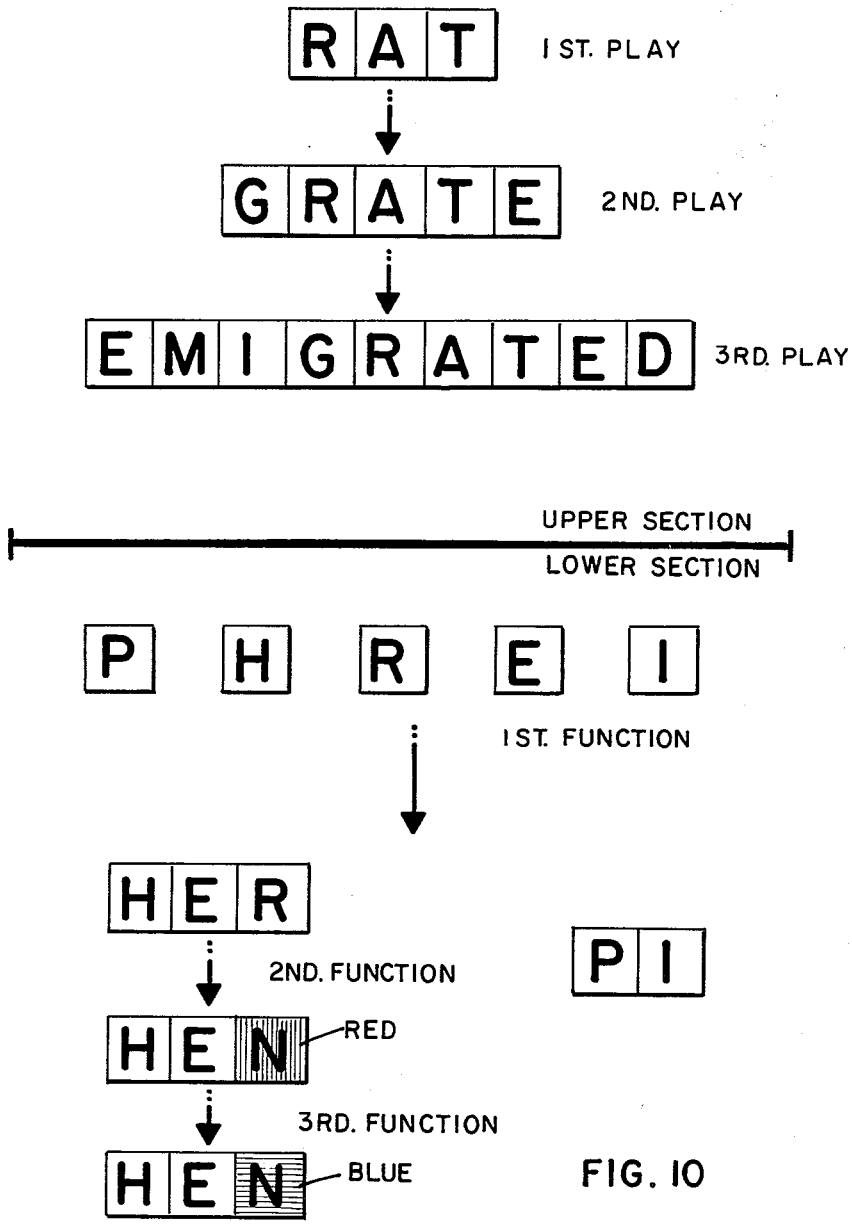
FIG. 10 is a schemematic, diagramatic representation of possible play sequences in the upper and lower sections of the board game of FIGS. 1 and 1A.

Reference is now made to FIGS. 1, 1A and 10 of the drawing. FIGS. 1 and 1A show the possible completion of play of two words in the upper section 20 namely —EMIGRATED— and —OUTWARDLY— and the interim play of discarded tiles in the lower section 22. FIG. 10 illustrates schemetically one possible progression to the word —EMIGRATED— in the upper section and one of the possible plays of discarded tiles in the lower sections.

As illustrated, the first play forms the word —RAT— using tiles having red indicia as illustrated. The second play adds the tiles G having blue indicia and E orange indicia to form the word —GRATE—. The third play adds the tiles E having red indicia, M having orange indicIa, I having green indicia, and D having green indicia to form the word —EMIGRATED—. Since the number of red tiles predominate, the word is won by the player having the red tile set. Similarly the possible plays for the word —OUTWARDLY— would as follows: First play forms the word —WARD— using tiles having blue indicia and the second play adds the tiles —OUT— and—L— using tiles having orange indicia and — Y—having red indicia to form the word —OUTWARDLY—. The word is neutralized. Since the orange and blue tiles are equal in number, no point is scored. It is to be understood that the term play as used in the illustrations could be succeeding turns of the same player or succeeding turns of different players. Referring now to FIG. 10 there is illustrated only one of the possible plays of the discarded tiles P, H, R, E, I. As illustrated the letters are played as —HER— and —PI—. The foregoing illustrates a first function of the lower or crib section, that is, discarding of letters in the form of words. A second function is illustrated when a player draws a tile having the letter N, for example, and substitutes the tile —N— for the tile —R— in the word —HER— without regard to color indicia. A third function or other variation of the second function of the lower section is illustrated when the player has a tile with the letter —N— and blue indicia and desires the tile with the letter —N— and red indicia for play in the upper section. Then the substitution is made in the word —HEN— in the lower section.

It is to be understood that various changes and modifications may be made in the illustrative form of the apparatus described herein within the scope of the invention. For example, reference being made now to FIG. 9, the game board 10 may be provided with a suitable support means upon which the game board can be rotated to the next succeeding player for better viewing of the board. One suitable support means comprises a support base 72 having a convex pin 74 which engages concave receptical 76 in the lower surface of the playing surface thereby providing relative rotation of the board game about its vertical axis upon the support base 72. Additionally for example, tiles could be placed on the squares on the playing surface as the result of manipulation of dice, spinners or any other suitable chance device or sequence.

Figure 11:
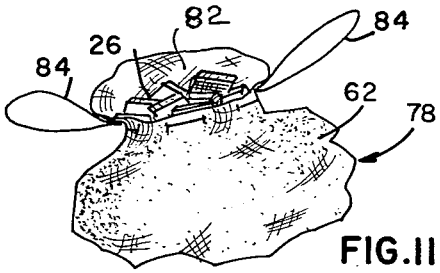
FIGS. 11 and 11A are prospective views of another embodiment of randomized playing piece selector holders.
Figure 11A:
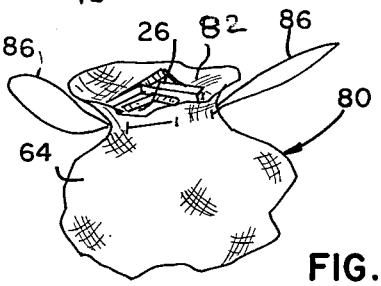

Referring now to FIGS. 11 and 11A, there is illustrated another embodiment of a randomized playing piece selector holder means. As shown, the playing piece holder means comprises a pair of purses or bags 78 and 80. The purses are preferably provided with suitable means to releasably close the openings 82. Suitable means are drawn strings 84 and 86. The holder 78 can, for example, contain tiles 26 having indicia on the face side representing alphabetic consonant characters, while the holder 80 can contain tiles having indicia representing alphabetic vowel characters or blanks. The tile holders 78 and 80 and their tile contents, can be distinguished from each other by means of indicia 62 on tile holder 78 and indicia 64 on tile holder 80 as described hereinbefore. It is also understood that other suitable marks or symbols can be used to distinguish the holder with consonant letter tiles from the holder with blank and vowel lettered tiles. Play is carried out in the same manner as described above with the selected tiles being placed in their respective holders. The tiles in each holder 78 and 80 may be periodically shuffled by drawing the strings 84 and 86 and shaking. Tiles 26 selected for play may be placed, as shown, adjacent to the board 10 of FIG. 1A in a holder, shown generally at 88, comprising support 90 and a groove 92 for receiving and holding the tiles 26. In this embodiment of the invention, a separate bin member 94 having bins 96 may be placed adjacent to tile holder 90 to hold tiles in the same manner as bins 60 of FIG. 7 although the purses 78 and 80 are sufficient for holding tiles separate in the manner described above.

The number of tiles in play has been described as 8 with a consonant to vowel-blank ratio of 5 to 3, but may be varied without departing from the scope of the invention. For example, 7 play tiles can be employed as shown at 88 with a ratio of consonants to vowel-blank tiles of 4 to 3.

While the invention has been described with respect to preferred embodiment, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrated and not in limiting sense.

What is claimed is:

1. A board game apparatus comprising a playing board having a flat surface, to receive, thereon, playing pieces having a definite configuration, and adapted to be used by at least two players comprising:

means on said flat surface dividing said surface into first and second sections, the surfaces of said first and second sections adapted to receive playing pieces placed in juxtaposition on said surfaces to form words, a plurality of sets of playing pieces, means disposed on each said set of playing pieces distinguishing each said set from other sets, means disposed on the top surface of certain playing pieces of each said set representing alphabetical characters selected from the group consisting of consonants and vowels, other means disposed on the top surface of certain playing pieces of each said set representing the absence of said alphabetical characters, other means disposed on certain playing pieces of each said set whereby the playing pieces of each said set are divided into two subgroups comprising a first group consisting of playing pieces having alphabetical consonants on the top surface and a second group consisting of playing pieces having alphabetical vowel characters or the absence of alphabetical characters on the top surface.

2. A board game apparatus of claim 1 further comprising means for holding each said set of playing pieces during the playing of the game comprising a first holding means for releasably holding playing pieces having said means on the top surface representing alphabetical consonants, and second holding means for releasably holding playing pieces having said means on the top surface representing vowel characters and the absence of alphabetical characters.

3. The board game apparatus of claim 1 further comprising a playing piece holder for holding each said set of playing pieces during the playing of the game comprising, means for holding a portion of the playing pieces in a top surface up position ready for view and play by the player, and other means for holding the remaining playing pieces in a top surface down position ready for selection by the player.

4. The playing piece holder of claim 3 wherein the holder comprises a container having a slot means for holding a portion of the playing pieces in a top surface up position ready for view and play by the player and a plurality of bin means for holding the remaining pieces in top surface down position ready for selection by the player.

5. The board game apparatus of claim 1 wherein the means disposed on each set of playing pieces distinguishing each said set from other sets comprises a distinguishable color.

6. A board game apparatus comprising a playing board having a flat surface, to receive, thereon, playing pieces having a definite configuration and adapted to be used by 2 to 4 players comprising:

means on said flat surface dividing said surface into first and second sections, the surfaces of said first and second sections adapted to receive playing pieces placed in juxtaposition on said surfaces to form words, a plurality of sets of playing pieces, means disposed on each said set of playing pieces distinguishing each said set from other sets, means disposed on the top surface of certain playing pieces of each said set representing alphabetical characters selected from the group consisting of consonants and vowels, other means disposed on the top surface of certain playing pieces of each said set representing the absence of said alphabetical characters, other means disposed on certain playing pieces of each said set whereby the playing pieces of each said set are divided into two subgroups comprising a first group consisting of playing pieces having alphabetical consonants on the top surface and a second group consisting of playing pieces having alphabetical vowel characters or the absence of alphabetical characters on the top surface, and means for holding each said set of playing pieces during the playing of the game comprising means for holding a portion of playing pieces in top surface up position for view by the player and other means for holding the remaining playing pieces in top surface down position.

7. The board game apparatus of claim 6 wherein each said sets of playing pieces comprises thirty playing pieces consisting of twenty nine pieces having alphabetical characters disposed thereon and one playing piece having no alphabetical character thereon.

8. A board game apparatus comprising a playing board having a flat surface, to receive, thereon, playing pieces having a definite configuration and adapted to be used by at least 2 players comprising:

means on said flat surface dividing said surface into first and second sections, means on said first section dividing the playing surface into a plurality of areas conforming substantially to the configuration of said playing pieces and adapted to receive playing pieces in juxtaposition to form words, means on said second section dividing the playing surface into a plurality of areas conforming substantially to the configuration of said playing pieces and adapted to receive playing pieces in juxtaposition to form words, a plurality of sets of playing pieces, means disposed on each said set of playing pieces distinguishing each said set from other sets, means disposed on the top surface of certain playing pieces of each said set representing alphabetical characters selected from the group consisting of consonants and vowels, other means disposed on the top surface of certain playing pieces of each said set representing the absence of alphabetical characters, and means disposed at least on the bottom surface of certain playing pieces of each said set whereby the playing pieces of each said set is divided into two groups comprising a first group consisting of playing pieces having alphabetical consonants on the top surface and a second group consisting of playing pieces having alphabetical vowel characters or the absence of alphabetical characters on the top surface.

9. The board game apparatus of claim 8 further comprising a playing piece holder for holding each said set of playing pieces during the playing of the game comprising means for holding a portion of the playing pieces in a top surface up position ready for view and play by the player and other means for holding the remaining playing pieces in a top surface down position ready for selection by the player.

10. The board game apparatus of claim 8 further comprising:

walls means disposed upon the flat surface about the periphery of said upper and lower sections, hinge means dividing said playing board into portions whereby the walls means of each portion may be folded into abutting relationship to form a chamber therebetween.

11. The board game apparatus of claim 8 further comprising:

means for rotably supporting said flat surface about its vertical axis.

* * * * *